US008499387B2

(12) United States Patent
Gharieni

(10) Patent No.: US 8,499,387 B2
(45) Date of Patent: Aug. 6, 2013

(54) TREATMENT COUCH

(71) Applicant: Gharieni GmbH, Moers (DE)

(72) Inventor: Samy Gharieni, Heusden-Zolder (BE)

(73) Assignee: Gharieni GmbH, Moers (DE)

( * ) Notice: Subject to any disclaimer, the term of this patent is extended or adjusted under 35 U.S.C. 154(b) by 0 days.

(21) Appl. No.: 13/644,855

(22) Filed: Oct. 4, 2012

(65) Prior Publication Data

US 2013/0086747 A1 Apr. 11, 2013

(30) Foreign Application Priority Data

Oct. 7, 2011 (DE) ..... 10 2011 115 097

(51) Int. Cl.
*A61G 13/08* (2006.01)

(52) U.S. Cl.
USPC ..... 5/622; 5/623; 5/621; 5/624

(58) Field of Classification Search
USPC ..... 5/621–624, 646, 648, 600–603
See application file for complete search history.

(56) References Cited

U.S. PATENT DOCUMENTS

| | | | | |
|---|---|---|---|---|
| 5,742,962 | A * | 4/1998 | Yoshino et al. | 5/623 |
| 6,446,287 | B2 * | 9/2002 | Borders | 5/618 |
| 6,704,959 | B2 | 3/2004 | Schuerch | |
| 6,821,288 | B2 * | 11/2004 | Schaeffer | 606/240 |
| 7,234,180 | B2 * | 6/2007 | Horton et al. | 5/613 |
| 7,454,806 | B2 * | 11/2008 | Koch et al. | 5/624 |
| 2004/0158926 | A1 | 8/2004 | Stevens | |
| 2008/0236599 | A1 | 10/2008 | Earle | |

FOREIGN PATENT DOCUMENTS

| | | | |
|---|---|---|---|
| DE | 882476 | C | 7/1953 |
| DE | 7021163 | U | 6/1970 |
| DE | 8107962 | U1 | 3/1981 |
| DE | 3708680 | C2 | 3/1987 |
| DE | 29818536 | U1 | 10/1998 |
| DE | 10120357 | A1 | 4/2001 |
| DE | 202009011447 | U1 | 8/2009 |
| FR | 2627683 | A1 | 9/1989 |

OTHER PUBLICATIONS

German Search Report cited in priority DE 10 2011 115 097.1, date mailed Jun. 14, 2012.

European Search Report cited in corresponding EP 12187240.2, date mailed Jan. 17, 2013.

* cited by examiner

*Primary Examiner* — Fredrick C. Conley
(74) *Attorney, Agent, or Firm* — BainwoodHuang

(57) ABSTRACT

A treatment couch (1) having a first headrest (2) and a second headrest (3), wherein at least one first armrest (4) is assigned to the first headrest (2) and at least one second armrest (5) is assigned to the second headrest (3) and wherein the at least one first armrest (4) is adjustable independently of the first headrest (2) and the at least one second armrest (3) is adjustable independently of the second headrest (5). Such a treatment couch is capable of providing flexibility and saving space.

11 Claims, 2 Drawing Sheets

TREATMENT COUCH

Figure 1:
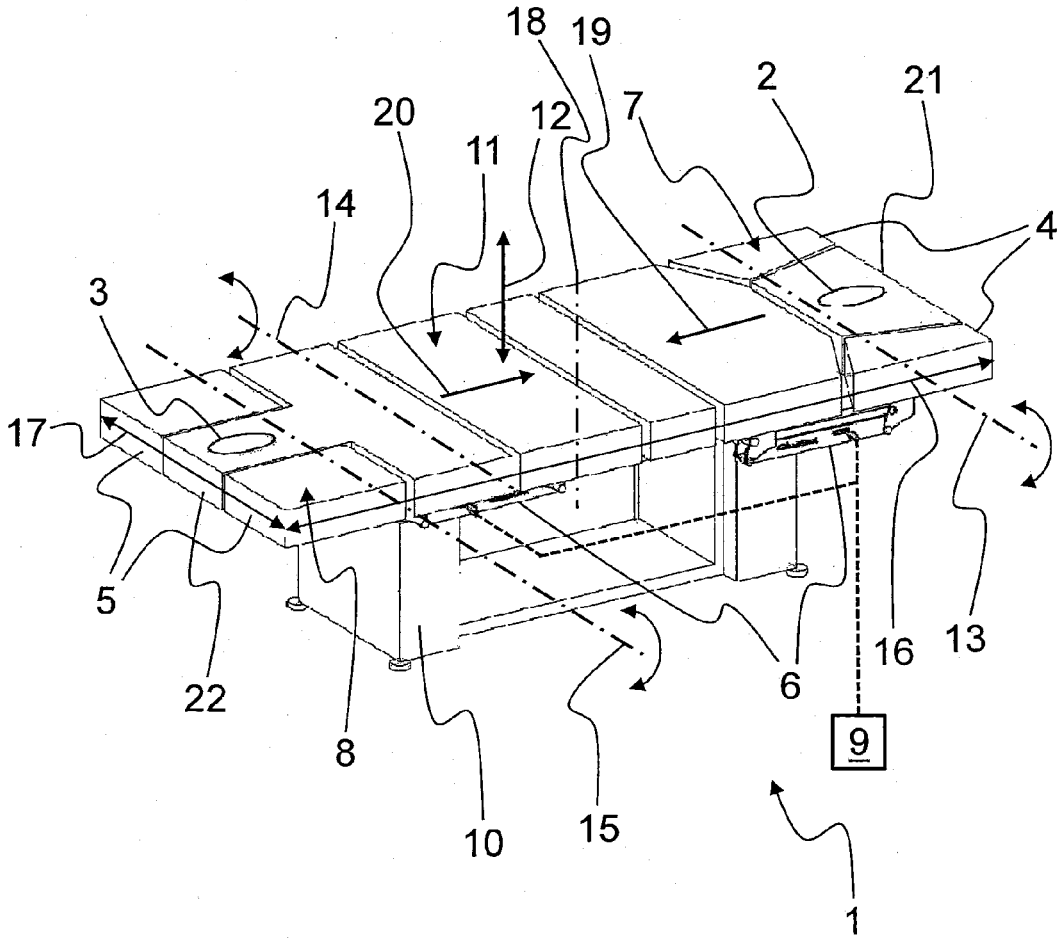

The present invention relates to a treatment couch for wellness treatments and/or medical applications.

Treatment couches are known with a lying surface, wherein the lying surface is often adjustable in its tilt at least in some regions in order to position a person to be treated in a suitable position depending on the treatment form and treatment objective. To increase lying comfort, treatment couches often have a headrest at one end, by means of which a lying direction on the lying surface is predetermined. The headrest can be embodied, for example, as a circular recess in the lying surface, in which the person to be treated can lay his head comfortably. The tilt of the headrest can also often be adjusted in the case of known treatment couches. Furthermore, it is known to assign armrests for both arms of the person to be treated to a headrest of a treatment couch. These armrests can be arranged ergonomically in relation to the headrest such that the arms are comfortably supported depending on the treatment situation.

However, the known treatment couches have the disadvantage that with them the lying direction on the lying surface is predetermined by the design due to the arrangement of the headrest and the armrests. As a result, persons or patients using the headrest and the armrests can lie comfortably on such treatment couches in only one lying direction. In order for a treating person to be able to treat all the parts of the person's body, a treatment couch of this type has to be regularly accessible from all sides. A space-saving installation of such treatment couches, for example, with the head against a wall is therefore often not possible.

The object of the invention is therefore to at least partially solve the problems described in connection with the prior art and in particular to disclose a treatment couch that is flexibly applicable and can be installed in a space-saving manner in a treatment room.

These objects are attained with a treatment couch as disclosed herein. It should be noted that the features individually listed herein can be combined with one another in any technologically useful manner and define further embodiments of the invention.

The treatment couch according to the invention has a first headrest and a second headrest, wherein at least one first armrest is assigned to the first headrest and at least one second armrest is assigned to the second headrest and wherein the at least one first armrest is adjustable independently of the first headrest and the at least one second armrest is adjustable independently of the second headrest.

The treatment couch proposed here is used in particular for wellness treatments and/or medical applications. The treatment couch for this purpose has a frame, for example in the manner of table legs, supports and/or a base, on which a lying surface is arranged. The lying surface can be embodied in a padded manner and have a length of preferably 1.5 m (meters) to 2.5 m as well as a width of preferably 0.5 m to 1.5 m. The height of the lying surface is preferably adjustable in a vertical direction and is preferably between 0.1 m to 1.5 m depending on the case of use.

In contrast to the known treatment couches, the treatment couch according to the invention proposed here has a first headrest and a second headrest, wherein at least one first armrest is assigned to the first headrest and at least one second armrest is assigned to the second headrest. The first headrest and the second headrest are preferably arranged at two ends of the treatment couch lying opposite one another in a longitudinal direction of the treatment couch, so that a person when placing his head on the first headrest can lie from his head in the direction of his feet in a first lying direction on the lying surface and when placing his head on the second headrest can lie from his head in the direction of his feet in a second lying direction on the lying surface, wherein the second lying direction is preferably rotated essentially by 180° about a vertical axis of the treatment couch to the first lying direction. Headrest means in particular a region of the treatment couch that is ergonomically shaped such that a person's head can be supported particularly comfortably thereon. In particular the headrest differs from a residual lying surface of the treatment couch. The first headrest and/or second headrest is embodied in particular as a round or oval recess in a lying surface. Furthermore, the first headrest and/or the second headrest, however, can also be embodied as a separate element of the treatment couch. Assignment of the at least one armrest to the first headrest and assignment of the at least one second armrest to the second headrest should be understood to mean that the at least one first armrest and the at least one second armrest is ergonomically arranged relative to the respective headrest such that the arms of a person on the lying surface, depending on the headrest used, can be laid on the at least one first armrest or on the at least one second armrest.

If the treatment couch is not accessible from one side because, for instance, it is arranged with the head against a wall of a treatment room, the patient can change his lying direction on the treatment couch without this being associated with a disadvantage in terms of lying comfort or the treatment possibilities. Furthermore, it is also possible to design the first headrest and the at least one first armrest ergonomically differently compared to the second headrest and the at least one second armrest in order to be able to treat persons with different anatomical prerequisites, such as different heights, on the same treatment couch. To this end, for example, a size and/or ergonomic design of the first headrest can be embodied differently from a size and/or ergonomic design of the second headrest and/or a size and/or ergonomic design of the at least one first arm rest can be different from a size and/or ergonomic design of the at least one second armrest. In particular a base area of the at least one first armrest can be embodied differently from a base area of the at least one second armrest. Furthermore, it is also preferred that the at least one second armrest is arranged such that it serves as a footrest or, when lowered, as a free space for feet, when a person is lying on the treatment couch in the first lying direction. Accordingly, it is likewise preferred that the at least one first armrest is arranged such that it serves as a footrest or, when lowered, as a free space for feet, when a person is lying on the treatment couch in the second lying direction. Furthermore, the lying surface of the treatment surface can be composed of several adjustable segments so that the lying surface in particular can be brought into a pointed-roof shaped position in which a lap of a person in the prone position regularly comes to rest essentially in the region of a "roof ridge" of the lying surface in the pointed-roof shaped position. The region of the lying surface designated here as a "roof ridge" is in particular an upper leading edge of two adjustable segments, which forms the upper peak of a pointed-roof shaped position of the lying surface.

The at least one first armrest is furthermore adjustable independently of the first headrest and the at least one second armrest is adjustable independently of the second headrest, for example, with regard to their height, their lateral spacing, their tilt and/or rotation.

Furthermore, it is advantageous if the at least one first armrest or the at least one second armrest are lowerable. Lowerable is understood here in particular to mean that the at least one first armrest and/or the at least one second armrest are adjustable in their height or lateral position, for example, in that they are pivoted, rotated and/or moved laterally out of the lying surface downwards or sideways. Hereby a particularly comfortable lying position can be adjusted for the patient.

Furthermore, it is advantageous if the at least one first armrest or the at least one second armrest is adjustable by means of a drive.

Preferably, the treatment couch has two first armrests and two second armrests. This has the advantage that the armrests are separately adjustable for each arm.

It is likewise advantageous if the at least one first armrest has a trapezoid base area and the at least one second armrest has a rectangular base area. Depending on the lying direction, different arm positions can be adopted hereby.

According to a further expedient embodiment, the treatment couch has a control, wherein the control is designed to adjust or to lower the at least one first armrest or the at least one second armrest depending on a specific treatment form in predetermined positions.

Figure 2:
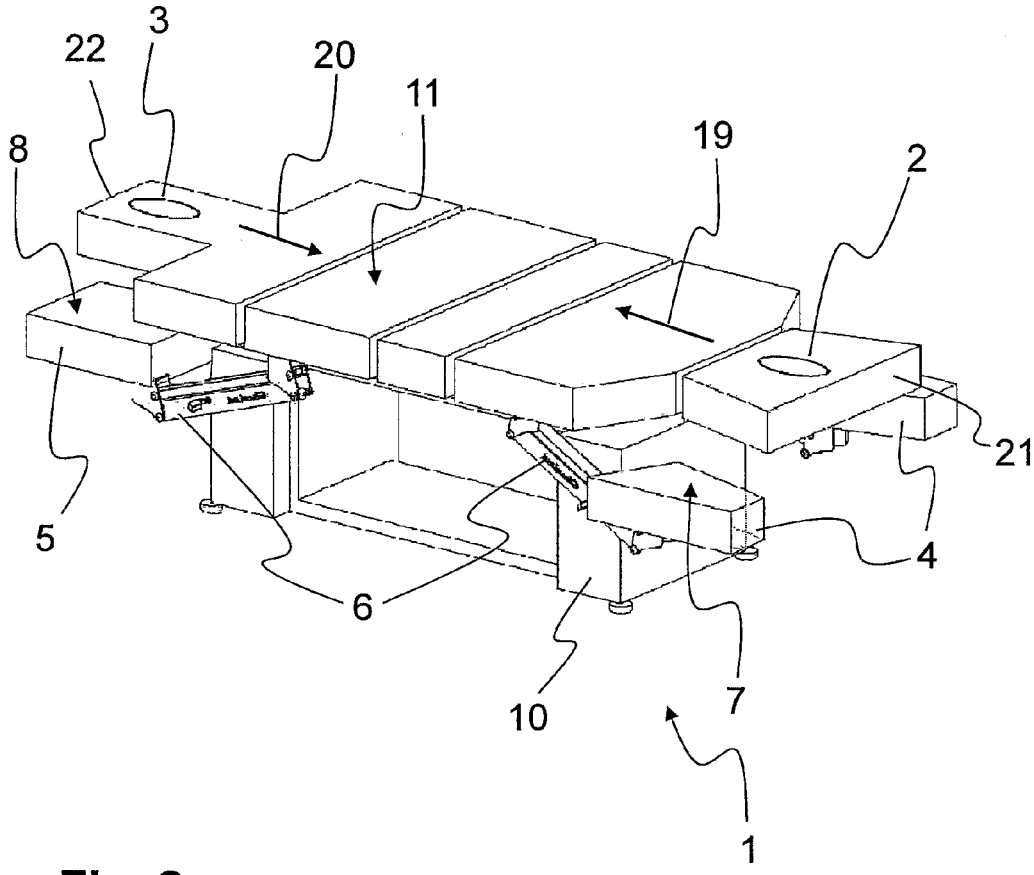

The invention and the technical environment are explained in more detail below based on the figure. It should be noted that the figure shows a particularly preferred embodiment variant of the invention, but is not limited thereto. It shows diagrammatically:

FIG. 1 an example embodiment of a treatment couch according to the invention in a first view, and FIG. 2 the example embodiment of the treatment couch according to the invention in a second view.

The teachings of German Application No. DE 10 2011 115 097.1, which was filed on Oct. 7, 2011, are incorporated by reference in their entirety.

FIG. 1 shows a treatment couch 1 with a lying surface 11, which is adjustable in its height on a frame 10 in the vertical direction 12. The lying surface 11 has a length 16 and a width 17 and includes at a first end 21 a first headrest 2, which in this example embodiment is embodied as an oval recess of the lying surface 11. Two first armrests 4 are assigned to the first headrest 2 to the right and left at the first end 21. The two first armrests 4 have a trapezoid base area 7. The first headrest 2 and the two first armrests 4 are rotatably supported about a first rotation axis 13. It should be clarified here that the first headrest 2 and the first armrest 4 do not have to have a common rotation axis 13, but likewise can have different rotation axes 13. With the use of the first headrest 2 and the two first armrests 4, a person lies in a first lying direction 19 on the lying surface 11.

Furthermore, the lying surface 11 includes at a second end 22 a second headrest 3 and two second armrests 5, which are assigned to the second headrest 3. The two second armrests 5 have respectively rectangular base areas 8. The second headrest 3 in this example embodiment is embodied as an oval recess in the lying surface 11. The second headrest 3 is adjustable about a second rotation axis 14 and the two second armrests 5 are adjustable about a third rotation axis 15. With the use of the second headrest 3 and the two second armrests 5, a person lies in a second lying direction 20 on the lying surface 11. The second lying direction 20 is rotated about a vertical axis 18 by essentially 180° relative to the first lying direction 19. With the use of the treatment couch 1 in the first lying direction 19, the two second armrests 5 can be used as footrests or, when lowered, as free space for feet. With the use of the treatment couch 1 in the second lying direction 20, the two first armrests 4 can be used in a corresponding manner as footrests or free space for feet.

The adjustment of the first headrest 2, the second headrest 3, the two first armrests 4 and the two second armrests 5 takes place by drives 6. The drives 6 are connected in a data-conducting (or electronic) manner (indicated here by dashed lines) to a control (or electronic controller) 9. In a simpler form, not shown, the drives can be formed by pneumatic springs or hydraulic systems.

FIG. 2 shows the treatment couch 1 in a second view, wherein the same elements of the treatment couch 1 are shown with the same reference numbers as in FIG. 1, so that only the differences in both representations are dealt with below. In contrast to the representation in FIG. 1, the first headrests 4 and the second headrests 5 in FIG. 2 are adjusted out of the lying surface 11, in particular lowered downwards. If a person is lying on the lying surface 11 in the first lying direction 19, his feet can hang comfortably in the free space above the second armrests 5 without bending or without using an external roll. If a person is lying on the lying surface 11 in the second lying direction 20, his feet can be allowed to hang comfortably in the free space above the first armrests 4 without bending or without the use of an external roll.

In view of the above-described features, such a treatment couch is capable of providing flexibility and saving space.

LIST OF REFERENCE NUMBERS

1 Treatment couch
2 First headrest
3 Second headrest
4 First armrest
5 Second armrest
6 Drive (electric or hydraulic)
7 Trapezoid base area
8 Rectangular base area
9 Control
10 Frame
11 Lying surface
12 Vertical direction
13 First rotation axis
14 Second rotation axis
15 Third rotation axis
16 Length
17 Width
18 Vertical axis
19 First lying direction
20 Second lying direction
21 First end
22 Second end

The invention claimed is:

1. A treatment couch having a lying surface, a first headrest and a second headrest, the first headrest and the second headrest being arranged at two ends of the treatment couch lying opposite one another in a longitudinal direction of the treatment couch to enable a person when placing his head on the first headrest to lie from his head in the direction of his feet in a first lying direction on the lying surface and when placing his head on the second headrest to lie from his head in the direction of his feet in a second lying direction on the lying surface, a shape of the second headrest being ergonomically adapted to a shape of a person's head, wherein at least one first armrest is assigned to the first headrest and at least one second armrest is assigned to the second headrest and wherein the at least one first armrest is adjustable independently of the first headrest and the at least one second armrest is adjustable independently of the second headrest, the at least one second armrest being arranged to serve as a footrest and, when lowered, as a free space of the lying surface for feet when a person is lying on the treatment couch in the first lying direction, and the at least one first armrest being arranged to serve as a footrest and, when lowered, as a free space of the lying surface for feet when a person is lying on the treatment couch in the second lying direction.

2. The treatment couch according to claim 1, wherein the first headrest and the at least first armrest are ergonomically distinct from the second headrest and the at least second armrest.

3. The treatment couch according to claim 1, wherein the at least one first armrest or the at least one second armrest is adjustable by means of a drive.

4. The treatment couch according to claim 1, having two first armrests and two second armrests.

5. The treatment couch according to claim 1, wherein the at least one first armrest has a trapezoid base area and the at least one second armrest has a rectangular base area.

6. The treatment couch according to claim 1, having a control, wherein the control is designed to adjust the at least one first armrest or the at least one second armrest depending on a specific treatment form in predetermined positions.

7. The treatment couch according to claim 1, wherein the at least first armrest and the at least second armrest are sections of a rectangular lying surface.

8. The treatment couch according to claim 1, wherein at least one of the first headrest and the second headrest is embodied as a round recess in the lying surface.

9. The treatment couch according to claim 1, wherein at least one of the first headrest and the second headrest is embodied as a separate element of the treatment couch.

10. The treatment couch according to claim 1, wherein the lying surface includes a set of adjustable segments that serve to bring the lying surface into a pointed-roof shaped position.

11. The treatment couch according to claim 10, wherein a lap of the person comes to rest in a region of a roof ridge of the lying surface in the pointed-roof shape position when the person is in a prone position.

* * * * *